US010390124B2

(12) United States Patent
Lin

(10) Patent No.: US 10,390,124 B2
(45) Date of Patent: Aug. 20, 2019

(54) TRANSDUCER DEVICE

(71) Applicant: MERRY ELECTRONICS(SHENZHEN) CO., LTD., Guangdong (CN)

(72) Inventor: Po-Chang Lin, Taichung (TW)

(73) Assignee: MERRY ELECTRONICS(SHENZHEN) CO., LTD., Guangdong (CN)

( * ) Notice: Subject to any disclaimer, the term of this patent is extended or adjusted under 35 U.S.C. 154(b) by 0 days.

(21) Appl. No.: 15/867,671

(22) Filed: Jan. 10, 2018

(65) Prior Publication Data

US 2019/0075387 A1 Mar. 7, 2019

(30) Foreign Application Priority Data

Sep. 5, 2017 (TW) ..... 106130329 A

(51) Int. Cl.

| | |
|---|---|
| ***H04R 5/033*** | (2006.01) |
| ***H04R 1/10*** | (2006.01) |
| ***H04R 9/02*** | (2006.01) |
| *H04R 9/06* | (2006.01) |

(52) U.S. Cl.

CPC ..... *H04R 1/1041* (2013.01); *H04R 9/025* (2013.01); *H04R 1/1008* (2013.01); *H04R 9/06* (2013.01); *H04R 2420/07* (2013.01)

(58) Field of Classification Search

CPC ..... G08B 3/10; H04M 1/72522; H04R 1/00; H04R 9/06; H04R 9/025; H04R 1/1041; H04R 1/1008; H04R 5/033; H04R 1/10

USPC ..... 381/74, 150, 396

See application file for complete search history.

(56) References Cited

U.S. PATENT DOCUMENTS

2012/0294473 A1* 11/2012 Pierce ..... H04R 9/06 381/396

2015/0334477 A1* 11/2015 Macours ..... G08B 3/10 381/150

* cited by examiner

*Primary Examiner* — Paul Kim

*Assistant Examiner* — Ubachukwu A Odunukwe

(74) *Attorney, Agent, or Firm* — CKC & Partners Co., LLC

(57) ABSTRACT

The present disclosure provides a transducer device including a driver and an audio system. The driver includes a diaphragm, a magnet, and a voice coil. The diaphragm vibrates in response to an external force. The magnet provides a magnetic field. The voice coil unit generates an inducing voltage by inducing a variation of the magnetic field in response to a vibration of the diaphragm. The audio system is coupled to the voice coil and includes an audio playing circuit and a wake-up circuit. The audio playing circuit outputs an audio signal to the voice coil unit. The wake-up circuit receives the inducing voltage and boots up the transducer device when the inducing voltage satisfies a predetermined condition.

14 Claims, 8 Drawing Sheets

TRANSDUCER DEVICE

RELATED APPLICATIONS

This application claims priority to Taiwan Application Serial Number 106130329, filed Sep. 5, 2017, which is herein incorporated by reference.

BACKGROUND

Technical Field

The present disclosure relates to a transducer device. More particularly, the present disclosure relates to an acoustic transducer device.

Description of Related Art

Wireless earphones have been one of the main options for people to listen to various audio signals due to their convenience of use. In general, a set of wireless earphones has to be disposed with specific button structures or sensing elements that need to be powered (e.g., proximity sensors, Hall effect sensors, or microphones, etc.) for the user to turn on the power of the set of wireless earphones, such that the power of the set of wireless earphones may be turned on based on the user's activation.

However, the aforementioned ways need either specific mechanical designs (e.g., power buttons) or continuously powering the sensing elements, which may lead to unnecessary waste of space and power. Therefore, it is crucial to design wireless earphones that can save space and power.

SUMMARY

The present disclosure provides a transducer device including a driver and an audio system. The driver includes a diaphragm, a magnet, and a voice coil. The diaphragm vibrates in response to an external force. The magnet provides a magnetic field. The voice coil unit generates an inducing voltage by inducing a variation of the magnetic field in response to a vibration of the diaphragm. The audio system is coupled to the voice coil and includes an audio playing circuit and a wake-up circuit. The audio playing circuit outputs an audio signal to the voice coil unit. The wake-up circuit receives the inducing voltage and boots up a power of the transducer device when the inducing voltage satisfies a predetermined condition.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1A:
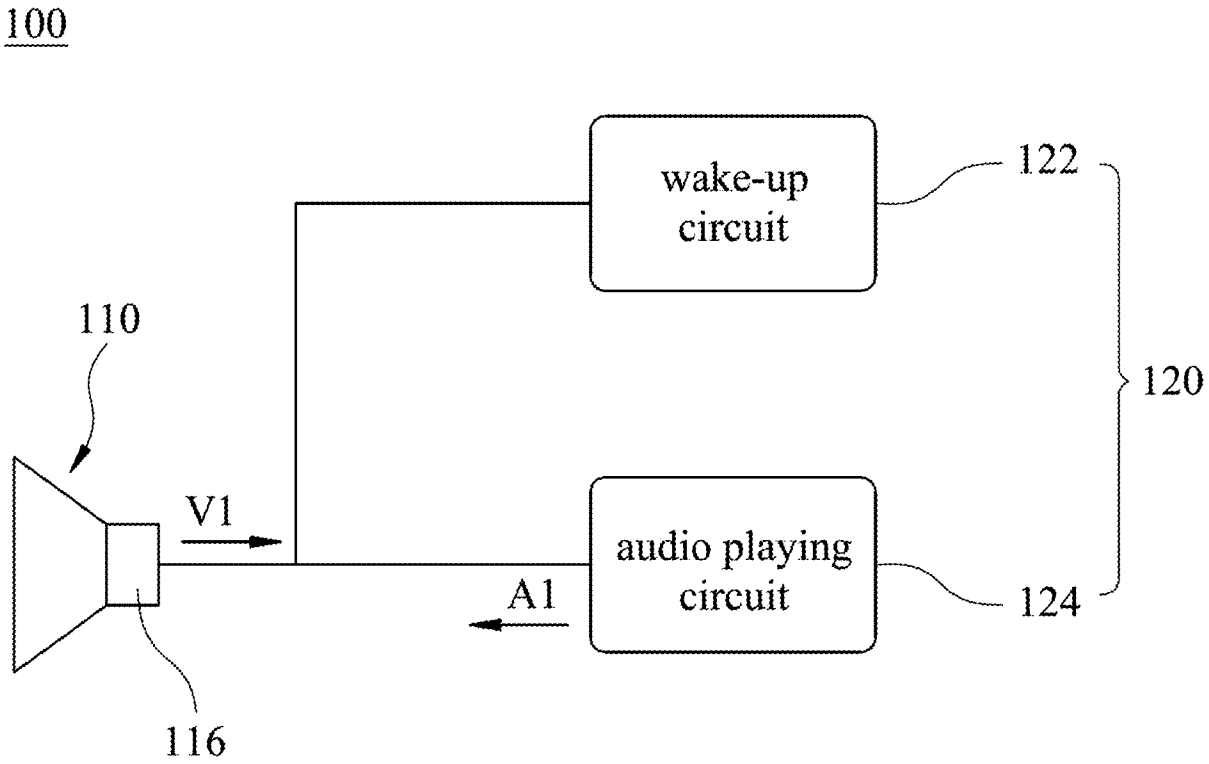
FIG. 1A is a schematic view of a transducer device of one embodiment of the present disclosure.
Figure 1B:
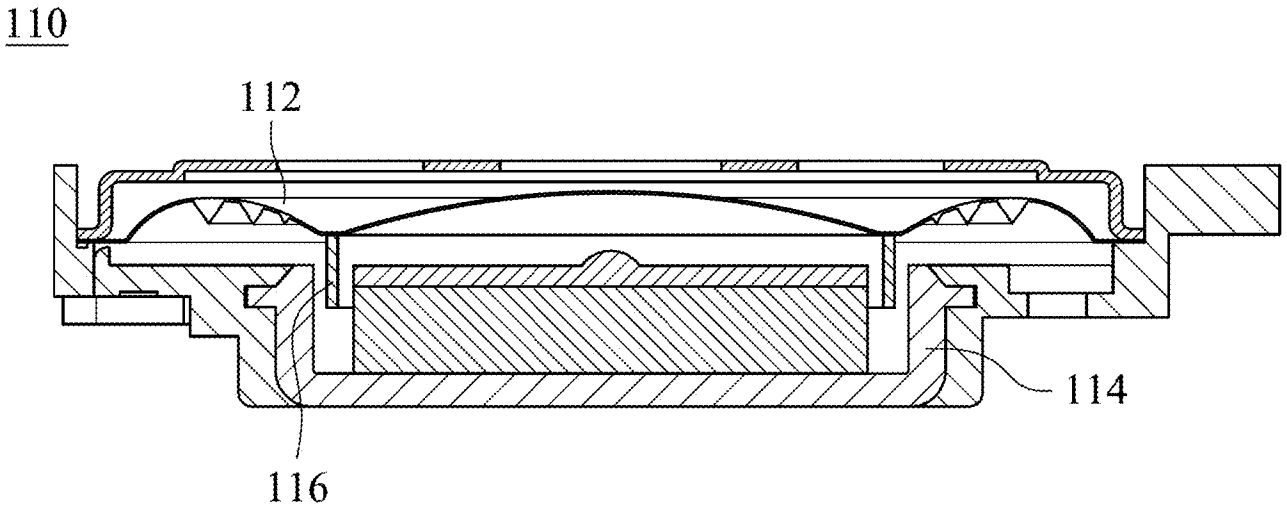
FIG. 1B is a schematic view of a driver of one embodiment of the present disclosure.

See FIG. 1A and FIG. 1B, wherein FIG. 1A is a schematic view of a transducer device 100 of one embodiment of the present disclosure and FIG. 1B is a schematic view of a driver 110 of one embodiment of the present disclosure. As shown in FIG. 1A and FIG. 1B, the transducer device 100 includes the driver 110 and an audio system 120. The driver 110 is, for example, a speaker and includes a diaphragm 112, a magnet 114, and a voice coil unit 116. The diaphragm 112 vibrates in response to an external force. The magnet 114 provides a magnetic field. The voice coil unit 116 generates an inducing voltage V1 by inducing a variation of the magnetic field in response to a vibration of the diaphragm 112. The audio system 120 is coupled to the voice coil unit 116 and includes a wake-up circuit 122 and an audio playing circuit 124. The audio playing circuit 124 outputs an audio signal A1 to the voice coil unit 116.

In the present embodiment, the audio system 120 may alternatively operate an on mode or a detection mode. Specifically, when the transducer device 100 is in an off state (i.e., the state where the transducer device 100 receives no operating voltage), the audio system 120 may operate the detection mode, and the wake-up circuit 122 will be correspondingly enabled. On the other hand, when the transducer device 100 operates in response to the operating voltage or is waked up by a wake-up signal (i.e., the transducer device 100 is in an on state), the audio system 120 may operate the on mode, and the wake-up circuit 122 will be correspondingly disabled.

In various embodiments, the external force may be an inner air pressure generated in the transducer device 100 when any part of the transducer device 100 takes forces.

For example, assuming that the transducer device 100 is one earmuff of a wireless headphone, the transducer device 100 is usually disposed with a foam for contacting with the user's ear. When the foam is tapped or pressed by the user, the air originally around the foam will be pushed into the earmuff to form an inner air pressure in the transducer device 100, and the inner air pressure may push the diaphragm 112 to vibrate the diaphragm 112.

For another example, assuming that the transducer device 100 is a wireless earphone, the transducer device 100 may be segmented into a front chamber and a back chamber based on the position of the driver 110. In this case, the external force is an inner air pressure generated when the front chamber or the back chamber is tapped, and the inner air pressure may push the diaphragm 112 to make the diaphragm 112 vibrate.

In addition, since a housing of the transducer device 100 may be disposed with an air leaking hole penetrating the housing, the air originally around the air leaking hole will be pushed into the transducer device 100 to form an inner air pressure in the transducer device 100 when the air leaking hole is tapped from the outside of the transducer device 100. In various embodiments, the inner air pressure may be enhanced by modifying the aspects of the air leaking hole or by a pressurizing unit attached to the air leaking hole, such that the vibration on the diaphragm 112 may be enhanced, and the related details will be discussed in the following paragraphs.

Since the magnet 114 may provide the magnetic field and the voice coil unit 116 may move in response to the vibration of the diaphragm 112, the voice coil unit 116 may generate an inducting voltage V1 by inducing the variation of the magnetic field in response to the vibration of the diaphragm 112.

In detail, when the transducer device 100 uses the driver 110 to play music (i.e., the audio system 120 is in the on mode), the audio playing circuit 124 outputs the audio signal A1 (e.g., an alternating current signal) to the voice coil unit 116, such that the magnetic field provided by the voice coil unit 116 will vary based on the audio signal A1. In this case, the magnetic field of the voice coil unit 116 will repel or attract the magnetic field provided by the magnet 114, and hence the voice coil unit 116 will be reciprocatingly moved to drive the diaphragm 112 pushing the air to generate voice for the user to listen. However, when the transducer device 100 is in the off state (i.e., the audio system 120 is in the detection mode), the diaphragm 112 of the embodiments of the present disclosure may vibrate in response to the external forces to reversely drive the voice coil unit 116 to reciprocatingly move, such that the voice coil unit 116 locating in the magnetic field of the magnet 114 may induce the magnetic field of the magnet 114 to generate the inducing voltage V1. When the transducer device 100 is in the off state, the inducing voltage V1 generated by the voice coil unit 116 is fed to the wake-up circuit 122 to turn on a power of the transducer device 100.

Afterwards, the wake-up circuit 122 receives the inducing voltage V1 and turns on the power of the transducer device 100 when the inducing voltage V1 satisfies a predetermined condition, in which the audio system 120 switches from the detection mode to the on mode.

In one embodiment, the predetermined condition may be whether the inducing voltage V1 is larger than a predetermined threshold. When the inducing voltage V1 is larger than the predetermined threshold, the wake-up circuit 122 may determine that the inducing voltage V1 satisfies the predetermined condition and accordingly turn on the power of the transducer device 100. Since the inducing voltage V1 is essentially positively related to the amplitude of the vibration of the diaphragm 112 and the amplitude of the vibration of the diaphragm 112 is positively related to the external force, the greater the external force results in the larger inducing voltage V1. Therefore, the designer may set the predetermined threshold as a value that is empirically high, such as 200 mV. In this case, the user has to tap or press the foam, the front chamber, the back chamber, the air leaking hole, or other parts on the transducer device 100 with certain forces to turn on the power of the transducer device 100. From another perspective, when the predetermined threshold is set to be a higher value, the situation of the wake-up circuit 122 accidentally turning on the transducer device 100 in response to smaller external forces can be avoided. As a result, when the transducer device 100 is placed in locations such as a pocket or a bag, the power thereof will not be accidentally turned on by slight frictions.

In another embodiment, the predetermined condition may be whether a predetermined number of the inducing voltage V1 larger than a predetermined threshold occurs in a predetermined duration. For example, assuming that the predetermined duration is 2 seconds, the predetermined number is 3, and the predetermined threshold is 200 mV, the wake-up circuit 122 may determine that the inducing voltage V1 satisfies the predetermined condition when 3 values of the inducing voltage V1 larger than 200 mV occur in 2 seconds, and hence the power of the transducer device 100 can be turned on. That is, the user in this case has to tap or press the transducer device 100 for more than 3 times with enough forces in 2 seconds to turn on the power of the transducer device 100. Accordingly, the possibility of the transducer device 100 being accidentally booted up can be further reduced.

In various embodiments, the wake-up circuit 122 may be coupled to a power management circuit (not shown) which may provide the transducer device 100 with an operating voltage to turn on the power of the transducer device 100. Alternatively, the wake-up circuit 122 may turn on the power of the transducer device 100 by sending a wake-up signal, but the present disclosure is not limited thereto. Consequently, there's no need to dispose mechanisms such as power buttons or sensing elements on the transducer device 100, and the sensing elements do not need to be continuously powered as well, such that the space and the power of the transducer device 100 can be saved.

Moreover, as mentioned in the above, since the wake-up circuit 122 will be respectively disabled and enabled in the on mode and the detection mode of the audio system 120, the relationships between the resistance of the wake-up circuit 122 (represented by a first resistance), the resistance of the audio playing circuit 124 (represented by a second resistance), and the resistance of the driver 110 (represented by a third resistance) may vary in response to the mode of the audio system 120.

Specifically, when the audio system 120 is in the on mode, the first resistance will become infinite (i.e., open circuit) because the wake-up circuit 122 is disabled. Therefore, when the audio system 120 is in the on mode, the first resistance will be higher than the third resistance. Accordingly, most of the currents of the audio signal A1 outputted by the audio playing circuit 124 will flow to the driver 110 instead of reversely flowing to the audio system 120 as a reverse voltage to damage the audio system 120.

On the other hand, when the audio system 120 is in the detection mode, the first resistance of the wake-up circuit 122 will become lower than the second resistance because the wake-up circuit 122 is enabled. Accordingly, most of the inducing voltage V1 generated by the voice coil unit 116 will be fed to the wake-up circuit 122, and a part of the inducing voltage V1 leaking to the audio playing circuit 124 will be blocked by the second resistance.

Figure 2:
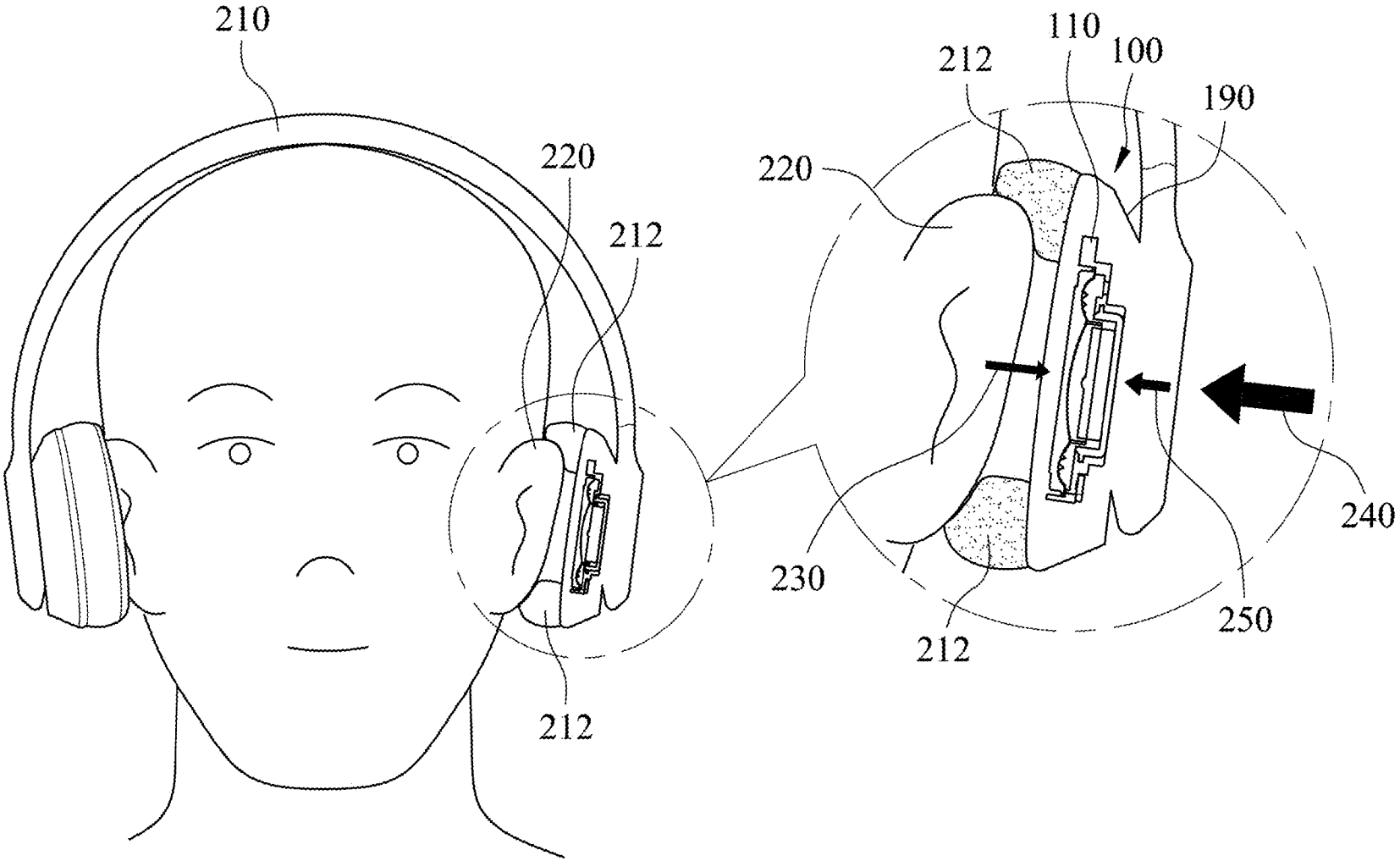
FIG. 2 is a schematic view of a scenario of using the transducer device according to one embodiment of the present disclosure.

See FIG. 2, which is a schematic view of a scenario of using the transducer device 100 according to one embodiment of the present disclosure. In the present embodiment, the transducer device 100 is, for example, one of the earmuffs of a wireless headset 210, and the transducer device 100 may be disposed with a foam 212 for contacting with an ear 220 of the user. When the user wears the wireless headset 210, the ear 220 may apply forces to the foam 212 at the moment that the user puts on the headset 210. In this case, the air originally around the foam 212 will be correspondingly pushed into the earmuff to form an inner air pressure 230 in the transducer device 100, and the inner air pressure 230 may push the diaphragm (not labelled) of the transducer device 100 to vibrate.

As mentioned in the above, when the amplitude of the vibration on the diaphragm is sufficiently large, the voice coil unit (not labelled) may generate enough inducing voltage for the wake-up circuit (not labelled) to turn on the power of the transducer device 100. That is, the power of the transducer device 100 will be automatically turned on when the user puts on the transducer device 100 without doing movements such as pressing power buttons. Therefore, the user may boot up the transducer device 100 in a more convenient and intuitive way.

In addition, when the power of the transducer device 100 is not successfully turned on via the aforementioned way at the moment the user puts on the wireless headset 210, the user may apply a force 240 to a housing 190 of the transducer device 100 by tapping or pressing, such that an inner air pressure 250 can be formed inside the transducer device 100. When the force 240 is great enough, the inner air pressure 250 may make the vibration on the diaphragm of the transducer device 100 large enough to turn on the power of the transducer device 100 based on the above teachings.

Figure 3:
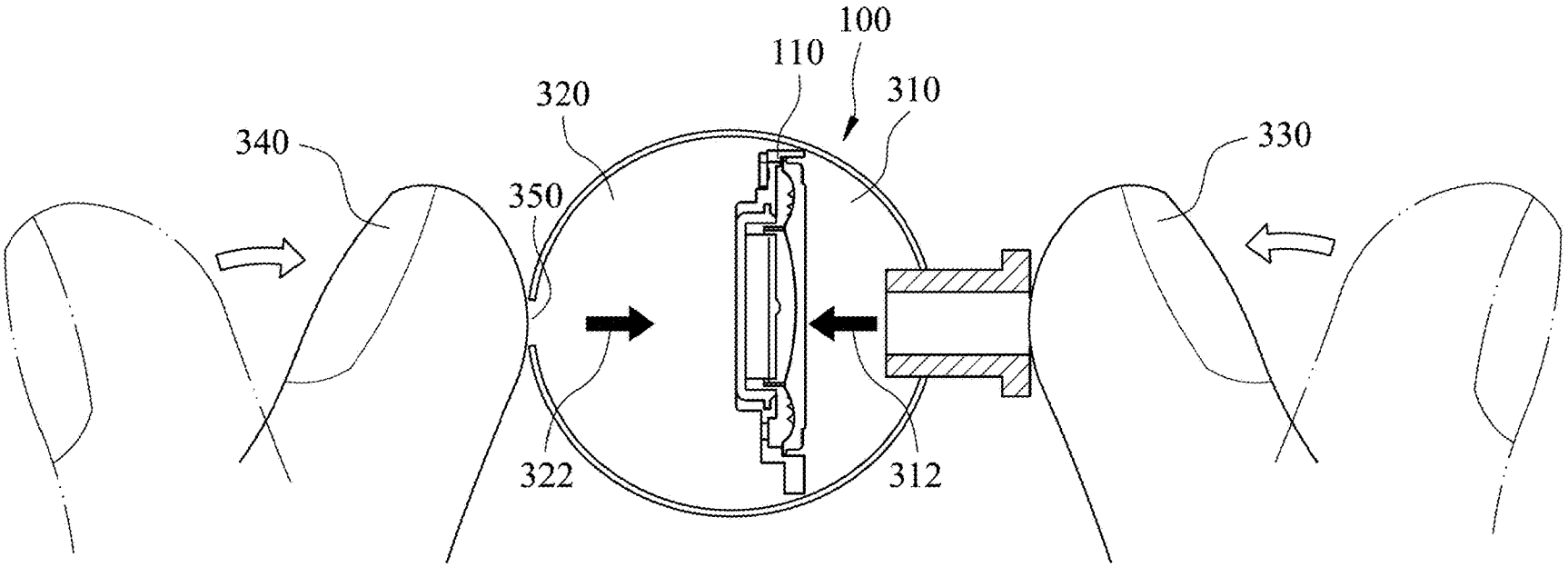
FIG. 3 is a schematic view of a scenario of using the transducer device according to one embodiment of the present disclosure.

See FIG. 3, which is a schematic view of a scenario of using the transducer device 100 according to one embodiment of the present disclosure. In the present embodiment, the transducer device 100 may be a wireless earphone, and the driver 110 thereof may segment the transducer device 100 into a front chamber 310 and a back chamber 320. As shown in FIG. 3, when the user wants to turn on the power of the transducer device 100, the user may tap the sound outlet of the front chamber 310 with a finger 330 to generate an inner air pressure 312 to vibrate the diaphragm (not labelled) of the transducer device 100. Alternatively, the user may use a finger 340 to tap an air leaking hole 350 of the back chamber 340 to generate an inner air pressure 322 to vibrate the diaphragm of the transducer device 100. When the inner air pressure 312 or the inner air pressure 322 is great enough, the vibration on the diaphragm of the transducer device 100 will be large enough, and hence the power of the transducer device 100 may be turned on based on the above teachings.

Figure 4A:
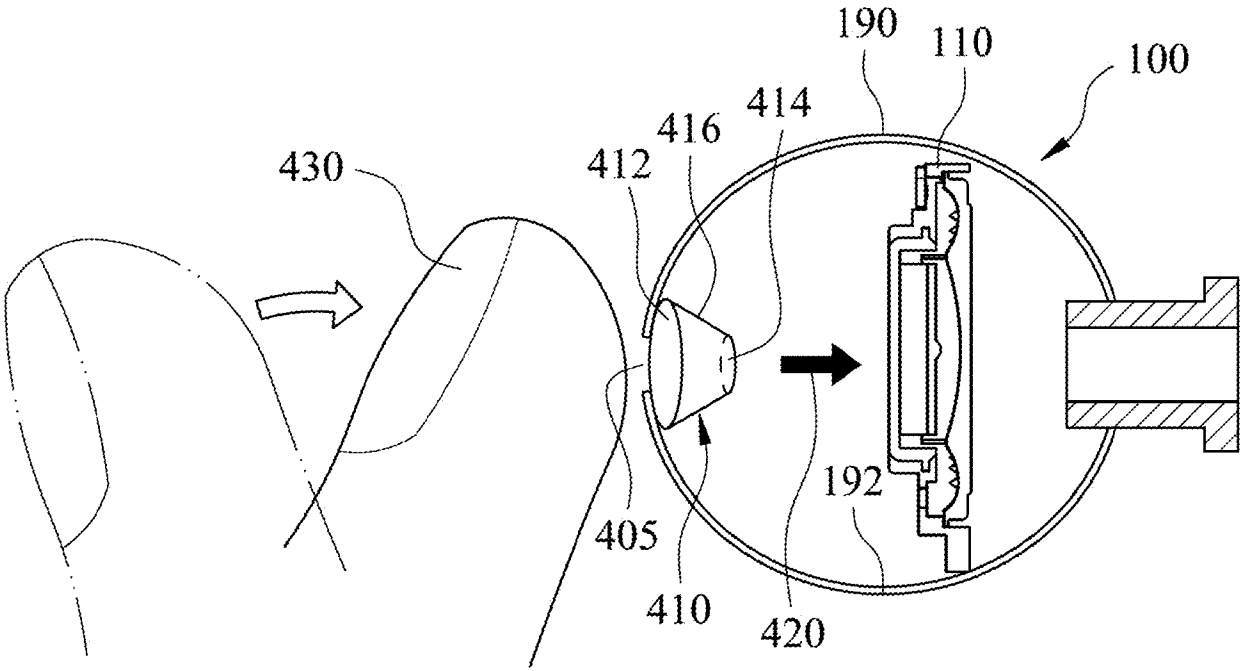
FIG. 4A is a schematic view of enhancing an inner air pressure by disposing a pressurizing unit according to one embodiment of the present disclosure.

See FIG. 4A, which is a schematic view of enhancing an inner air pressure 420 by disposing a pressurizing unit 410 according to one embodiment of the present disclosure. In the present embodiment, the transducer device 100 further include an air leaking hole 405 and the pressurizing unit 410. The air leaking hole 405 is disposed on the housing 190 of the transducer device 100 and penetrates the housing 190. The pressurizing unit 410 is attached to an inner wall 192 of the transducer device 100 and covers the air leaking hole 405 from the inside of the transducer device 100.

As shown in FIG. 4A, the pressurizing unit 410 includes an air inlet 412, an air outlet 414, and an annular slope 416. The air inlet 412 is attached to the inner wall 192 of the transducer device 100 and covers the air leaking hole 405 from the inside of the transducer device 100. The air outlet 414 is formed on another side opposite to the air inlet 412 and faces the diaphragm (not shown). The annular slope 416 is connected between the air inlet 412 and the air outlet 414, and a circumference of the annular slope 416 decreases from the air inlet 412 to the air outlet 414. As mentioned in the above, when the air leaking hole 405 is tapped or pressed by the user from the outside of the transducer device 100, the air originally around the air leaking hole 405 will be pushed into the transducer device 100 to form the inner air pressure 420 in the transducer device 100. However, since the pressurizing unit 410 has the annular slope 416 whose circumference decreases from the air inlet 412 to the air outlet 414 (i.e., the bore of the air inlet 412 is larger than the bore of the air outlet 414), the inner air pressure 420 may be further enhanced. In this way, the user may make the vibration on the diaphragm large enough without applying too much force, such that the power of the transducer device 100 can be turned on.

Figure 4B:
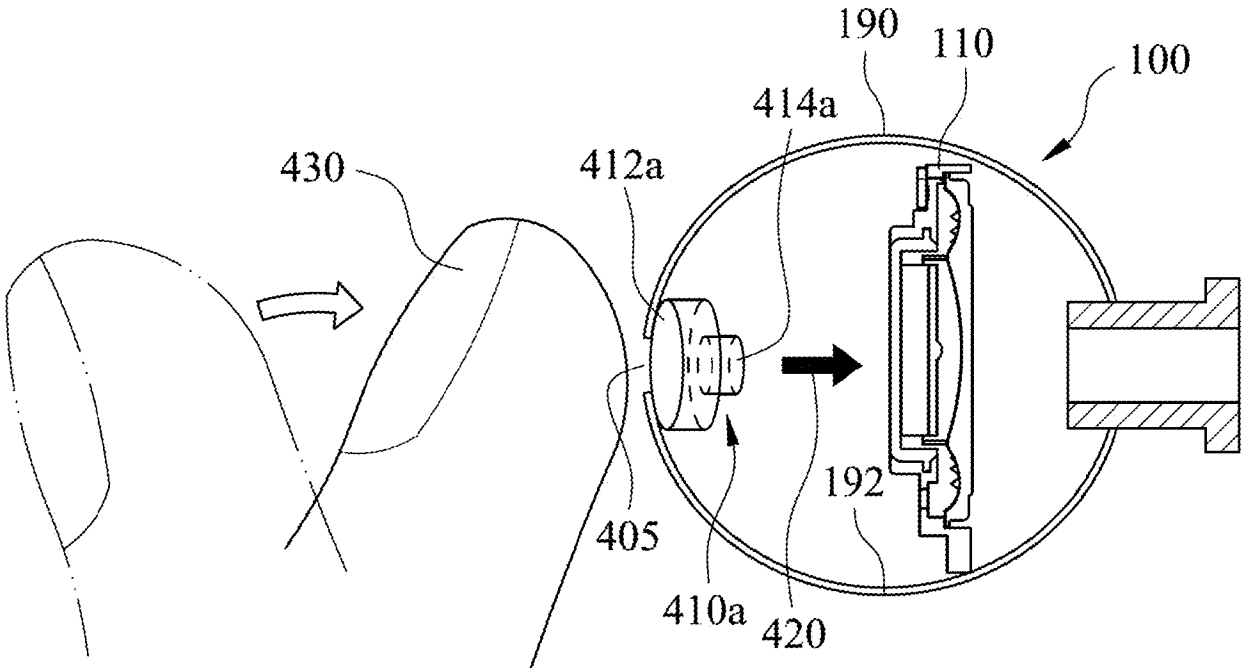
FIG. 4B is a schematic view of enhancing the inner air pressure by disposing a pressurizing unit according to FIG. 4A.

See FIG. 4B, which is a schematic view of enhancing the inner air pressure 420 by disposing a pressurizing unit 410*a* according to FIG. 4A. In the present embodiment, the pressurizing unit 410 of FIG. 4A may be replaced with the pressurizing unit 410*a* of FIG. 4B, wherein the pressurizing unit 410*a* may be attached to the inner wall 192 of the transducer device 100 and covers the air leaking hole 405 from the inside of the transducer device 100.

As shown in FIG. 4B, the pressurizing unit 410*a* includes an air inlet 412*a* and an air outlet 414*a*. The air inlet 412*a* is attached to the inner wall 192 of the transducer device 100 and covers the air leaking hole 405 from the inside of the transducer device 100. The air outlet 414*a* is formed on another side opposite to the air inlet 412*a* and faces the diaphragm (not shown), wherein a bore of the air inlet 412*a* is larger than a bore of the air outlet 414*a*. As mentioned in the above, when the air leaking hole 405 is tapped or pressed by the user from the outside of the transducer device 100, the air originally around the air leaking hole 405 will be pushed into the transducer device 100 to form the inner air pressure 420 in the transducer device 100. However, since the bore of the air inlet 412*a* is larger than the bore of the air outlet 414*a*, the inner air pressure 420 may be further enhanced. In this way, the user may make the vibration on the diaphragm large enough without applying too much force, such that the power of the transducer device 100 can be turned on.

Figure 4C:
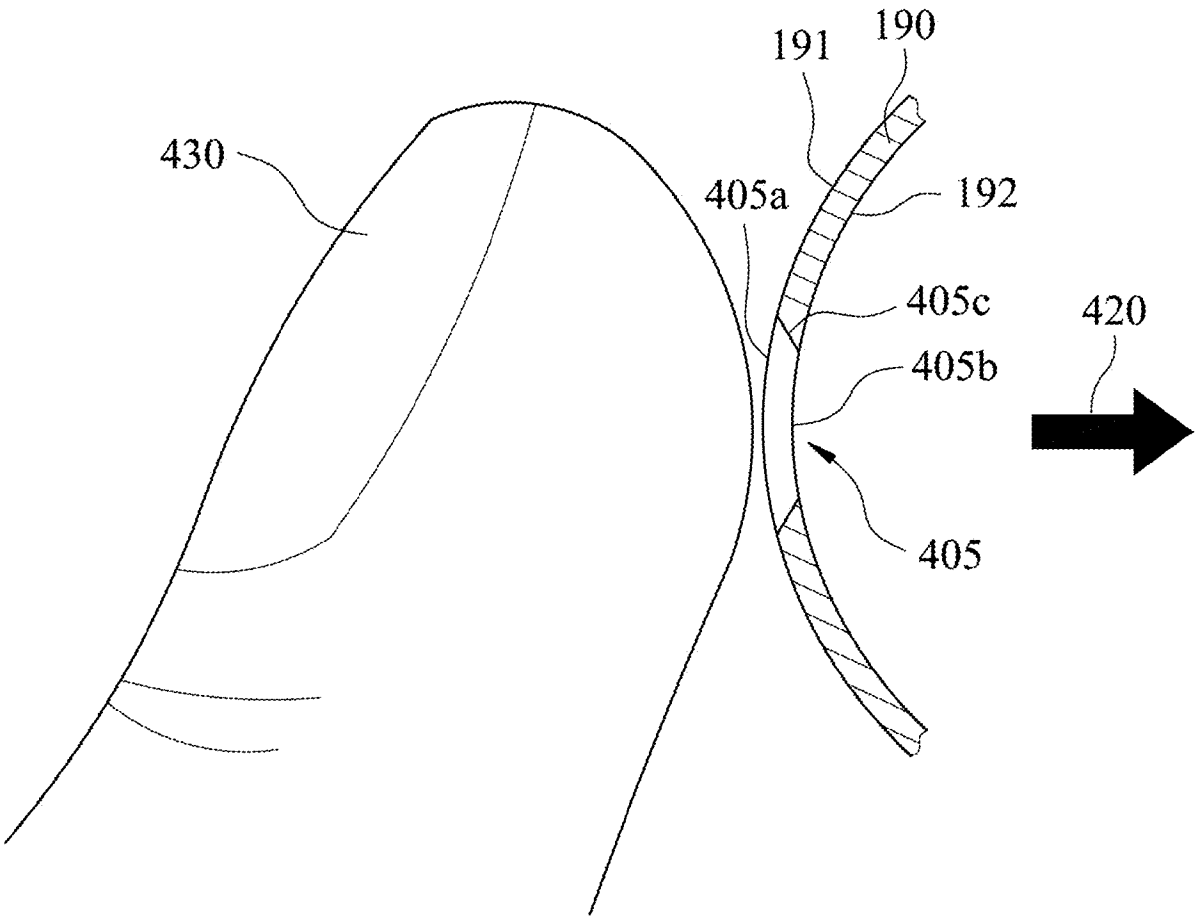
FIG. 4C is a schematic view of an air leaking hole of one embodiment of the present disclosure.

See FIG. 4C, which is a schematic view of an air leaking hole 405 of one embodiment of the present disclosure. In the present embodiment, the air leaking hole 405 may include an air inlet 405*a*, an air outlet 405*b*, and an annular slope 405*c*. The air inlet 405*a* is formed on an outer wall 191 of the housing 190. The air outlet 405*b* is formed on the inner wall 192 of the housing 190 and faces the diaphragm (not shown) of the transducer device 100. The annular slope 405*c* is connected between the air inlet 405*a* and the air outlet 405*b*, and a circumference of the annular slope 405*c* decreases from the air inlet 405*a* to the air outlet 405*b*. When the air leaking hole 405 is tapped or pressed by the user from the outside of the transducer device 100, the air originally around the air leaking hole 405 will be pushed into the transducer device 100 to form the inner air pressure 420 in the transducer device 100. However, since the air leaking hole 405 is disposed with the annular slope 405*c* whose circumference decreases from the air inlet 405*a* to the air outlet 405*c* (the bore of the air inlet 405*a* is larger than the bore of the air outlet 405*c*), the inner air pressure 420 may be further enhanced. In this way, the user may make the vibration on the diaphragm large enough without applying too much force, such that the power of the transducer device 100 can be turned on.

Figure 5:
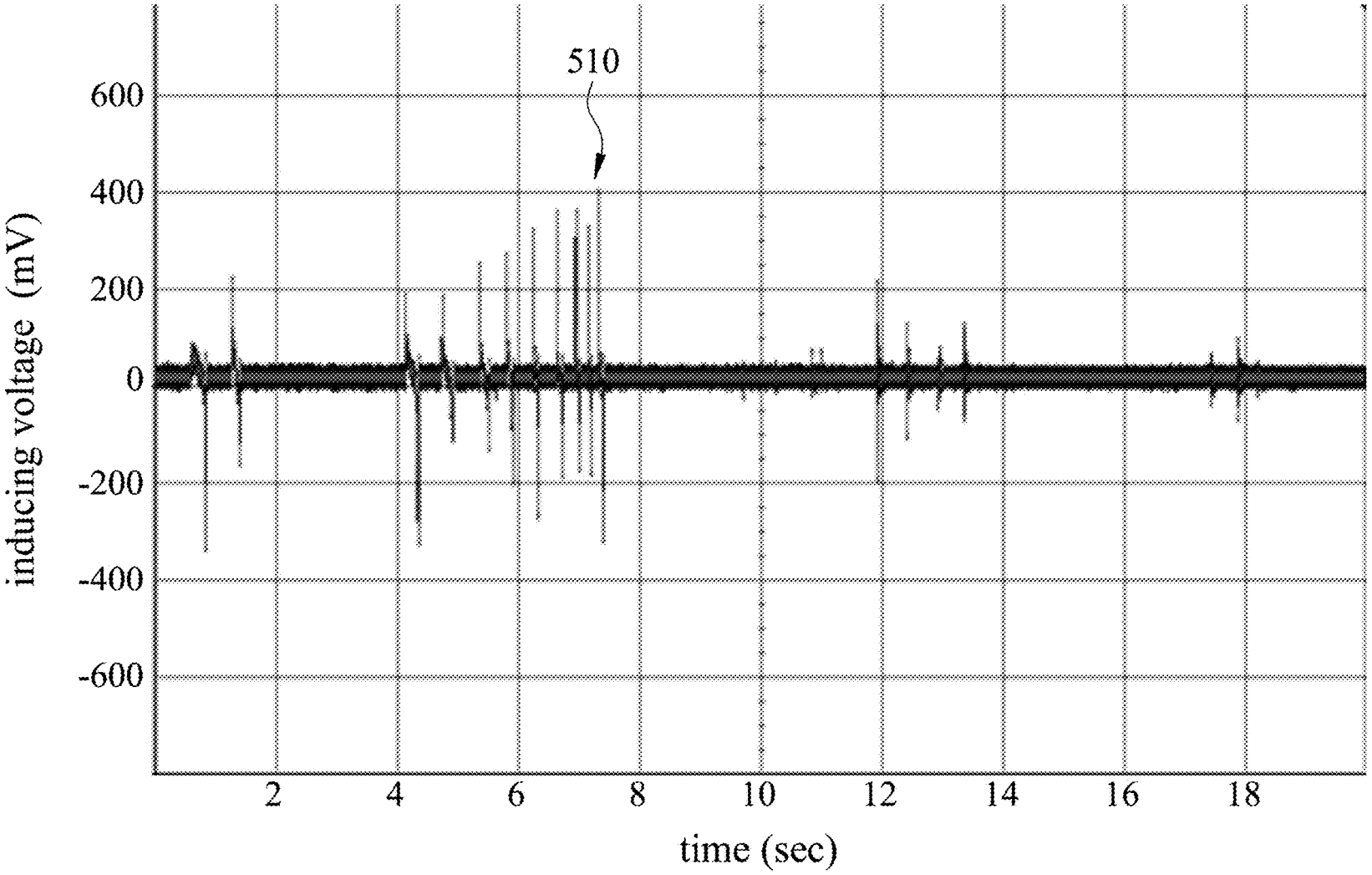
FIG. 5 is a measurement graph of the inducing voltage according to one embodiment of the present disclosure.

See FIG. 5, which is a measurement graph of the inducing voltage according to one embodiment of the present disclosure. In the present embodiment, the developer of the present disclosure taps a transducer device (not shown) of the present disclosure for several times and measures the inducing voltage generated by the voice coil unit (not shown) of the transducer device in response to the several times of tapping. As can be observed from FIG. 5, a plurality of intermittent and discontinuous pulses 510 occur on the inducing voltage in response to the several times of tapping. When the pulses 510 satisfy the aforementioned predetermined conditions (e.g., the pulses 510 are larger than the predetermined threshold or a predetermined number of the pulses 510 larger than a predetermined threshold occur in a predetermined duration), the power of the transducer device may be turned on, and the related details may be referred to the discussions of the previous embodiments, which will not be repeated herein.

To sum up, the transducer device of the present disclosure may generate the inducing voltage in response to the vibration on the diaphragm and accordingly turn on the power of the transducer device. In this way, the user may make the diaphragm vibrate by, for example, tapping the transducer device to turn on the power of the transducer device. Accordingly, the transducer device does not need to be disposed with mechanisms such as power buttons or continuously power the sensing elements, and hence the space and the power of the transducer device can be saved. Moreover, the vibration on the diaphragm may be enhanced by disposing the pressurizing unit in the transducer unit or modifying the aspect of the air leaking hole to be capable of pressurizing, such that the power of the transducer device may be turned on without too much force from the user.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A transducer device, comprising:

a driver, comprising:

a diaphragm vibrating in response to an external force;

a magnet providing a magnetic field; and a voice coil unit generating an inducing voltage by inducing a variation of the magnetic field in response to a vibration of the diaphragm; and an audio system coupled to the voice coil and comprising:

an audio playing circuit outputting an audio signal to the voice coil unit; and a wake-up circuit receiving the inducing voltage and booting up the transducer device when the inducing voltage satisfies a predetermined condition; and a pressurizing unit attached to an inner wall of the transducer device and covering an air leaking hole of the transducer device, the pressurizing unit comprising an air inlet and an air outlet, wherein a bore of the air inlet is larger than a bore of the air outlet.

2. The transducer device of claim 1, wherein the wake-up circuit is enabled by the inducing voltage generated from the voice coil unit when the transducer device is in an off state, and the wake-up circuit is disabled when the transducer device is in an on state.

3. The transducer device of claim 2, wherein when the transducer device is in the off state, the wake-up circuit receiving the inducing voltage and booting up the transducer device subsequently.

4. The transducer device of claim 1, wherein the transducer device further comprises a front chamber and a back chamber, and the external force is an inner air pressure generated when the front chamber or the back chamber is tapped.

5. The transducer device of claim 1, wherein the pressurizing unit further comprises an annular slope connected between the air inlet and the air outlet, and a circumference of the annular slope decreases from the air inlet to the air outlet.

6. The transducer device of claim 1, wherein the driver is a speaker.

7. The transducer device of claim 1, wherein the predetermined condition comprises whether the inducing voltage is larger than a predetermined threshold.

8. The transducer device of claim 1, wherein the predetermined condition comprises whether a predetermined number of the inducing voltage larger than a predetermined threshold occurs in a predetermined duration.

9. The transducer device of claim 1, wherein the audio system at least comprises an on mode and a detection mode.

10. The transducer device of claim 9, wherein the audio system operates the detection mode when the transducer device is in an off state, and the audio system switches to the on mode from the detection mode when the transducer device is booted up.

11. The transducer device of claim 9, wherein the wake-up circuit has a first resistance, the audio playing circuit has a second resistance, and the driver has a third resistance, wherein the first resistance is higher than the third resistance when the audio system is in the on mode, and the second resistance is higher than the first resistance when the audio system is in the detection mode.

12. The transducer device of claim 1, wherein the inducing voltage comprises intermittent and discontinuous pulses.

13. A transducer device, comprising:

a driver, comprising:

a diaphragm vibrating in response to an external force;

a magnet providing a magnetic field; and a voice coil unit generating an inducing voltage by inducing a variation of the magnetic field in response to a vibration of the diaphragm; and an audio system coupled to the voice coil and comprising:

an audio playing circuit outputting an audio signal to the voice coil unit; and a wake-up circuit receiving the inducing voltage and booting up the transducer device when the inducing voltage satisfies a predetermined condition; and an air leaking hole disposed on a housing of the transducer device and penetrating the housing, the air leaking hole comprising:

an air inlet formed on an outer wall of the housing; and an air outlet formed on an inner wall of the housing and facing the diaphragm, wherein a bore of the air inlet is larger than a bore of the air outlet.

14. The transducer device of claim 13, wherein the air leaking hole further comprises an annular slope connected between the air inlet and the air outlet, and a circumference of the annular slope decreases from the air inlet to the air outlet.

* * * * *